US005099736A.

United States Patent [19]

Evers

[11] Patent Number: 5,099,736

[45] Date of Patent: Mar. 31, 1992

[54] APPARATUS FOR OPENING ONE LAYER OF A TUBE-LIKE MATERIAL WEB

[75] Inventor: Wouter Evers, Hoenderloo, Netherlands

[73] Assignee: Audion Elektro B.V., Weesp,

[21] Appl. No.: 607,531

[22] Filed: Nov. 1, 1990

[30] Foreign Application Priority Data

Nov. 2, 1989 [NL] Netherlands ..... 8902710

[51] Int. Cl.[5] ..... B26D 3/08

[52] U.S. Cl. ..... 83/861; 53/459; 53/567; 53/570; 83/372; 83/578; 83/614

[58] Field of Search ..... 83/578, 861, 614, 372, 83/370; 493/201, 227, 340, 372; 53/567, 570, 459, 614

[56] References Cited

U.S. PATENT DOCUMENTS

| | | | |
|---|---|---|---|
| 2,835,037 | 5/1958 | Middents | 83/614 X |
| 3,269,087 | 8/1966 | Cloud et al. | 53/567 |
| 3,481,102 | 12/1969 | Dolman | 53/570 |
| 3,847,708 | 11/1974 | Takahashi et al. | 53/570 |
| 4,022,095 | 5/1977 | Jones | 83/614 X |
| 4,517,872 | 5/1985 | Dortscheff | 83/614 X |
| 4,590,834 | 5/1986 | Sobel | 83/614 X |
| 4,754,674 | 7/1988 | Perlman | 83/614 X |
| 5,036,740 | 8/1991 | Tsai | 83/614 X |

*Primary Examiner*—Douglas D. Watts
*Assistant Examiner*—Kenneth E. Peterson
*Attorney, Agent, or Firm*—Kane, Dalsimer, Sullivan, Kurucz, Levy, Eisele and Richard

[57] ABSTRACT

An apparatus for opening one layer of a tube-like material web comprises a cutting member and a straight support for guiding the material web, which support extends transverse to the longitudinal direction of the material web. The cutting member includes a cutting knife mounted on a carriage movable back and forth parallel to the support by means of a first driving member. The carriage carries a guiding element for guiding the carriage on the support during cutting open said one layer. The cutting knife projects with respect to the guiding element in the direction of the support along an adjustable length.

7 Claims, 2 Drawing Sheets fig.4

APPARATUS FOR OPENING ONE LAYER OF A TUBE-LIKE MATERIAL WEB

BACKGROUND OF THE INVENTION

The invention relates to an apparatus for opening one layer of a tube-like material web, comprising a cutting means and guiding means for guiding the material web.

Such an apparatus is disclosed for example in EP-A-0 269 145. In this known apparatus the cutting means includes a perforating knife which perforates both layers of the tube-like material web, whereafter the perforation in the upper layer is torn open by mechanical auxiliary means. This known apparatus has the disadvantage that the adjustment of the apparatus to the material web to be used is rather cumbersome, whereas the construction of the apparatus is complicated due to the required mechanical auxiliary means.

U.S. Pat. No. 4,586,318 discloses an apparatus of the above-mentioned type, wherein the cutting means includes a heated cutting wire which is pressed on said one layer of the tube-like material web. This known apparatus shows the disadvantage that the tube-like material web must be guided around a separation plate for separating both layers.

SUMMARY OF THE INVENTION

The invention aims to provide an apparatus of the above-mentioned type, wherein said disadvantages are obviated in a simple but nevertheless effective manner.

To this end the apparatus according to the invention is characterized in that one of said guiding means is made as a straight support for the material web extending transverse to the longitudinal direction of the material web and in that said cutting means includes a cutting knife mounted on a carriage movable back and forth parallel to the support by means of a first driving means, said carriage carrying a guiding element for guiding the carriage on the support during cutting open said one layer, wherein the cutting knife projects with respect to the guiding element in the direction of the support along an adjustable length.

In this manner an apparatus is obtained, by means of which the upper layer of the tube-like material web is cut open with certainty, wherein it is not necessary to make extremely high demands as to the tolerances in order to maintain the desired cutting depth, because the guiding element guides the carriage on the support during the cutting action, so that a fixed position of the carriage with respect to the support is guaranteed. By adjusting the projecting length of the cutting knife the desired cutting depth for cutting through the upper layer of the tube-like material web is then obtained.

According to a favourable embodiment of the apparatus according to the invention the carriage is movable between a rest position and an operating position by means of a second driving means, said guiding element and said cutting knife being at a distance from the support in the rest position of the carriage, said guiding element being pressed against the material web guided on the support in the operating position of the carriage, wherein said carriage comprises a detector for detecting the presence and absence, respectively, of the material web opposite of the cutting knife and for actuating the second driving means in such a manner that the carriage is in its operating and rest position, respectively.

BRIEF DESCRIPTION OF THE DRAWINGS

The invention will hereinafter be further explained by reference to the drawings, in which an embodiment of the apparatus according to the invention is schematically shown.

DETAILED DESCRIPTION OF A PREFERRED EMBODIMENT

Figure 1:
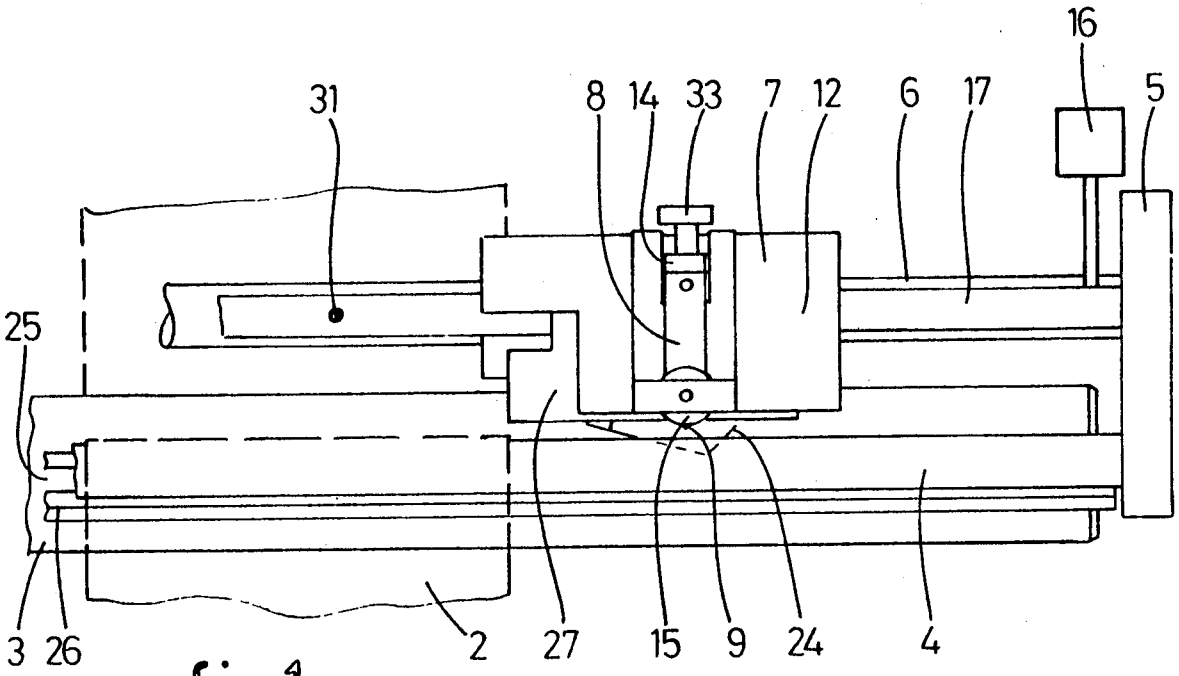
FIG. 1 is a partially shown top view of an embodiment of the apparatus according to the invention.
Figure 2:
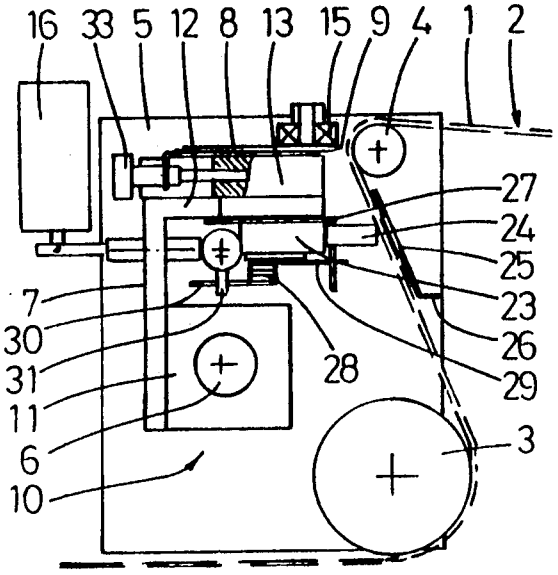
FIG. 2 is a side view partially in cross-section of the apparatus of FIG. 1.

Referring to FIGS. 1 and 2 there is shown an apparatus for opening the one layer 1 of a tube-like material web 2 for example of plastic material, which material web is guided along a first roller 3 and a cutting shaft 4. The cutting shaft 4 functions as a support for the material web 2 during the cutting action and can also be made in a different manner.

The complete apparatus is mounted between two support plates 5, one of which being shown in the drawings.

A hollow shaft 6 is mounted at a distance under the cutting shaft 4, a carriage 7 being guided on this shaft 6. Said carriage 7 supports a cutting knife 8 with a cutting point 9 for cutting through the layer 1 of the material web 2. To this end the carriage 7 is movable back and forth on the shaft 6 by means of a first driving means 10. During each movement of the carriage 7 along the material web 2 the cutting knife 8 can cut through the upper layer 1. Means for transporting the material web 2 will move the material web along a predetermined distance after each cutting action. These means do not form part of the present invention.

Said driving means 10 comprises a housing 11 which is slidably mounted on the shaft 6, whereas a magnet not shown in the drawing is movable back and forth within the hollow shaft by means of compressed air, which magnet cooperates with a magnet accommodated in the housing 11, so that the housing 11 will move together with the magnet driven by compressed air. Such driving means are known per se and need not to be described further. Of course, it is also possible to use another type of driving means for the carriage 7.

The carriage 7 is mounted on the housing 11 and is made as a substantially L-shaped plate. On the one leg 12 a support block 13 is provided, on the upper side of which a knife support 14 is slidably mounted. The cutting knife 8 is attached on this knife support 14. The knife point 9 of the cutting knife 8 projects with an adjustable length with respect to a bearing 15 mounted on the support block 13 and functioning as a guiding element of the carriage 7.

The carriage 7 is pivotable around the hollow shaft 6 by means of a second driving means 16, which in the embodiment shown is made as an electromagnet, which however can be replaced by any other suitable driving means. The driving means 16 actuates an excentric shaft 17 for moving the carriage 7 between a rest position shown in FIG. 3 and an operating position shown in FIG. 4. In the rest position of FIG. 3 the cutting knife 8 lies at a distance from the cutting shaft 4, while in the operating position of FIG. 4 the bearing 15 is pressed against the material web 2, so that the cutting knife 8 sticks into the layer 1 of the material web 2.

Figure 3:
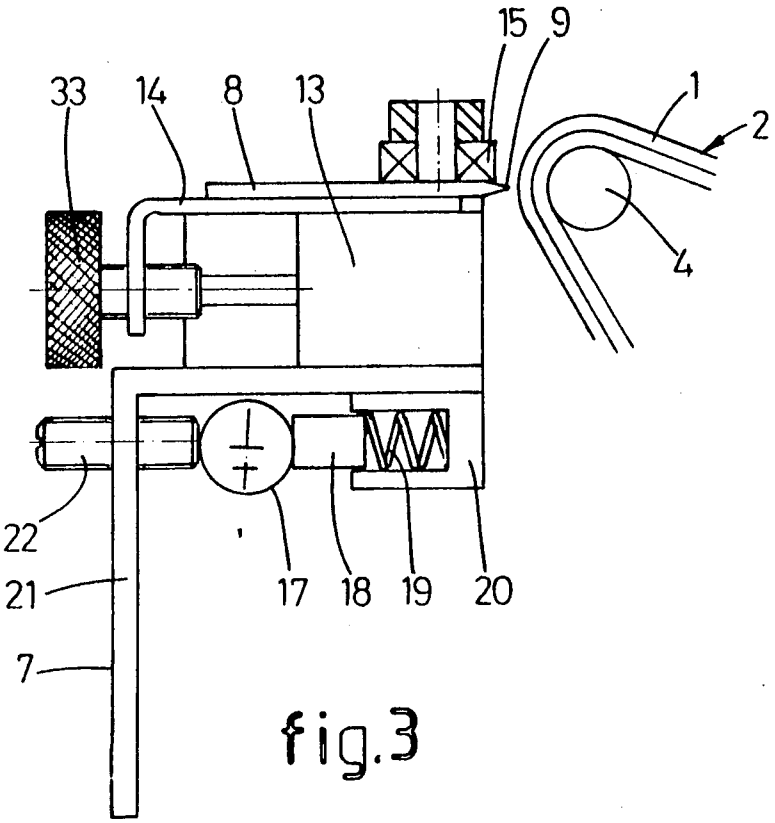
FIG. 3 is a partially shown side view of the apparatus of FIG. 1, wherein the carriage is in the rest position.
Figure 4:
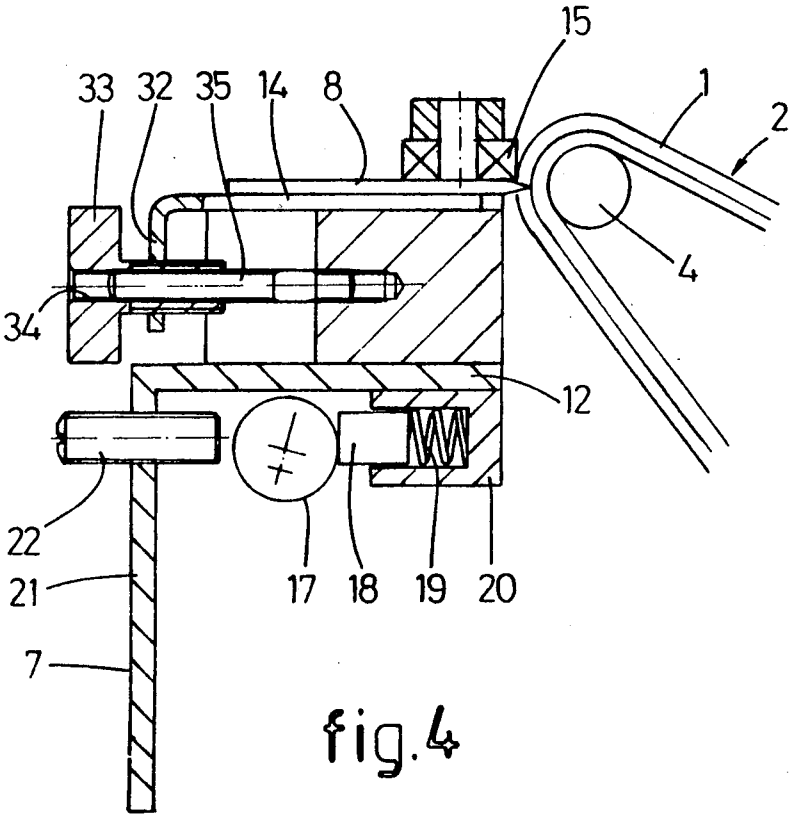
FIG. 4 shows a part of the apparatus in cross-section corresponding with FIG. 3, wherein the carriage is in the operating position.

The excentric shaft 17 engages a boss 18 which is slidably mounted in a bush 20 against the action of a spring 19. The shaft 17 can be rotated by the driving means 16 from the position of FIG. 3 to the position of FIG. 4, whereby the carriage 7 pivots towards the cutting shaft 4 and is pressed with the bearing 15 against the material web 2 with a force determined by the spring 19. The rest position of FIG. 3 is determined by a stop boss 22, which is screwed in the other leg 21 of the carriage 7. By adjustment of this boss 22 the centre line of the cutting knife 8 can be adjusted on the centre line of the cutting shaft 4, whereby a straight cut in the layer 1 of the material web as accurate as possible is obtained.

The driving means 16 is energized by a detector made as a microswitch 23, of which a switch arm 24 projects into a slot 25 of a guiding plate 26 for the material web 2 in absence of this material web 2. As soon as the switching arm 24 reaches the material web 2, the driving means 16 is energized and the carriage 7 pivots from the rest position of FIG. 3 into the operating position of FIG. 4.

In order to guarantee that the detector 23 only energizes the driving means 16 if the cutting knife 8 has reached the material web 2, the detector 23 is mounted on a slidable plate 27, by which the detector 23 is movable between two detection positions one at either side of the cutting knife 8. The plate 27 is slidable by means of a spring 28 operating as a lever, one end 29 of which is coupled with the plate 27 whereas the other end 30 is adapted to cooperate with a switching pin 31 mounted in the middle of the excentric shaft 17.

When the carriage 7 is moving from the position shown in FIG. 1 to the left, the cutting knife 8 will be opposite of the material web 2 first, whereafter the switching arm 24 reaches the material web and energizes the driving means 16. Subsequently the plate 27 is slided because the spring 28 is actuated by the switching pin 31, so that the switching arm 24 will lead with respect to the cutting knife 8 and de-energizes the driving means 16 as soon as the switching arm 24 will again enter into the slot 25 of the guiding plate 26. Thereby the carriage 7 will pivot back into the rest position before the end edge of the material web 2 is reached. During the return movement from the left to the right according to the view of FIG. 1, the cutting knife 8 will first reach the material web and subsequently the switching arm 24.

It is noted that the microswitch 23 with switching arm 24 can also be replaced by another type of detector, for example light detectors lying on either side of the cutting knife 8 with a corresponding logic control means. The detector should only guarantee that at detecting the presence and absence, respectively, of the material web 2 opposite of the cutting knife 8, the driving means 16 will be actuated in such a manner that the carriage 7 is in the operating and rest position, respectively.

The requirements as to the tolerances of the described apparatus, in particular as to the cutting shaft 4 and the hollow shaft 6, to guarantee the required cutting depth are not extremely high because during the cutting action the bearing 15 guides the carriage 7 on the cutting shaft 4 and the cutting knife 8 projects with respect to the bearing 15 along an adjustable length.

The projecting length of the cutting knife 8 can be adjusted because the knife support 14 has at its side opposite of the cutting knife 8 a downwardly bent leg 32 with a threaded hole, in which an adjusting screw is rotatable. This adjusting screw is provided with a central threaded bore 34, with which the adjusting screw 33 is rotatably mounted on a fixed threaded rod 35. The pitch of the thread in the bore 34 is equal to the same at the outer side of the adjusting screw 33, so that the displacement of the cutting knife 8 is determined by the difference between the pitch of the outer and the pitch of the inner thread. Thereby an accurate adjustment of the projecting length of the cutting knife 8 is possible.

The invention is not restricted to the above-described embodiment which can be varied in a number of ways within the scope of the claims.

I claim:

1. Apparatus for opening one layer of a tube-like material web with a longitudinal and transverse direction, comprising a cutting means and guiding means for guiding the material web, wherein one of said guiding means is made as a straight support for the material web extending transverse to the longitudinal direction of the material web and wherein said cutting means includes a cutting knife mounted on a carriage movable back and forth parallel to the support by means of a first driving means, said carriage carrying a guiding element for guiding the carriage on the support during cutting open said one layer, wherein the cutting knife projects with respect to the guiding element in the direction of the support along an adjustable length, wherein the carriage is movable between a rest position and an operating position by means of a second driving means, said guiding element and said cutting knife being at a distance from the support in the rest position of the carriage, wherein said carriage comprises a detector for detecting the presence and absence, respectively, of the material web opposite of the cutting knife and for actuating the second driving means in such a manner that the carriage is in its operating and rest position, respectively.

2. Apparatus according to claim 1, wherein the support is made as a round shaft and the guiding element of the carriage is a bearing.

3. Apparatus according to claim 1, wherein the detector is movable back and forth with respect to the carriage in the direction of movement thereof between two detection positions one at either side of the cutting knife, wherein a switch means is provided substantially in the middle of the path of movement of the carriage for moving the detector in the one or the other detection position, such that the detector as seen in the direction of movement of the carriage lags with respect to the cutting knife before the switch means is reached.

4. Apparatus according to claim 1, wherein the detector comprises a microswitch with a switch arm projecting into a slot of a guiding plate for the material web.

5. Apparatus according to claim 1, wherein the carriage is guided on a shaft extending parallel to the support at a distance under said shaft, said carriage being pivotable around said shaft between the rest and operating positions, wherein said second driving means includes a rotatable excentric shaft engaging a spring biased boss of the carriage.

6. Apparatus according to claim 5, wherein the rest position of the carriage is adjustable by means of an adjustable stop cooperating with said excentric shaft and lying opposite of the spring biased boss.

7. Apparatus according to claim 1, wherein the cutting knife is attached to a knife support having a leg with a threaded hole at its end opposite of the cutting knife, in which an adjusting screw is rotatable, said adjusting screw being rotatable with an internally threaded hole on a fixed threaded rod.

* * * * *